United States Patent [19]

Benedyk

[11] 4,230,752

[45] Oct. 28, 1980

[54] CIGARETTE BURN PROOF ARTIFICIAL GRASS

[75] Inventor: Joseph C. Benedyk, Highland Park, Ill.

[73] Assignee: Brunswick Corporation, Skokie, Ill.

[21] Appl. No.: 33,479

[22] Filed: Apr. 26, 1979

[51] Int. Cl.[3] ..... A41G 1/00

[52] U.S. Cl. ..... 428/17; 428/92; 428/97

[58] Field of Search ..... 428/17, 92, 97, 95

[56] References Cited

U.S. PATENT DOCUMENTS

| | | | |
|---|---|---|---|
| 3,332,828 | 7/1967 | Faria | 428/17 |
| 3,551,263 | 12/1970 | Carter | 428/17 |
| 3,837,980 | 9/1974 | Nishimura | 428/92 |
| 3,940,522 | 2/1976 | Wessells | 428/17 |
| 3,987,228 | 10/1976 | Hemming | 428/92 |
| 4,061,804 | 12/1977 | Mc Culloch | 428/92 |
| 4,104,428 | 8/1978 | Liu | 428/97 |

*Primary Examiner*—Marion Mc Camish

*Attorney, Agent, or Firm*—John L. Issac; William G. Lawler

[57] ABSTRACT

An artificial grass product with pile fibers having a modulus of elasticity of from 25,000 p.s.i. to 100,000 p.s.i. and a moment of inertia of from $1.06\times10^{-10}$in.$^4$ to $8.33\times10^{-9}$ in$^4$. For fibers of rectangular cross-section the fiber dimensions range from 0.004 in. to 0.010 in. in thickness and 0.020 in. to 0.100 in. in width. The fibers or product made therefrom may be exposed to ionizing radiation to promote cross-linking and increase resistance to cigarette burning.

26 Claims, 3 Drawing Figures

CIGARETTE BURN PROOF ARTIFICIAL GRASS

CROSS-REFERENCE TO RELATED APPLICATIONS

This application is related to copending applications of Joseph C. Benedyk Ser. No. 17,465, Docket No. 3982Y-N-USA and Ser. No. 33,483, which are incorporated herein by reference.

This invention relates to a novel cigarette-burn proof artificial grass product and to a method for imparting burn resistance to an artificial grass product by means of radiation cross-linking.

BACKGROUND OF THE INVENTION

It is well known that all types of artificial grass or turf made of conventional synthetic fibers such as polypropylene and nylon are readily disfigured by burning cigarettes which are all too often dropped on them by careless smokers. Cigarette burn scars are often seen on the surfaces of artificial grass or turf that cover the entrances to hotels, motels, office buildings, and patios. The problem involves the thermoplastic nature of the synthetic fibers (slit or split film inclined) used in the construction of the artificial grass pile and the continuous burning characteristics of cigarettes (additives, such as potassium nitrate, are added to cigarette tobacco to prevent self extinguishing).

U.S. Pat. No. 3,987,228 discloses a process for forming pile products by pressing a sheet of thermoplastic material (e.g., ethylene-vinyl acetate copolymer) against a heated surface and drawing fibrils from the surface of the sheet. The fibrils are then cross-linked while in a self-supporting position. It is noted that the cross-linking decreases the melt flow index which improves the abrasion resistance of the pile surface. It is further noted that the dimensional stability of the polymer at temperatures around its melting point is improved and the pile itself is stiffer and more resilient.

OBJECTS OF THE INVENTION

It is an object of the present invention to provide an artificial grass product that closely simulates the "feel" and look of natural grass and is highly resistant to cigarette burns.

Another object of this invention is to provide a pile fiber product made of fibers comprising particular polymers and having an elastic modulus and an area moment of inertia within a defined range.

A further object of this invention is to provide an artificial grass product having fibers with a modulus of elasticity and an area moment of inertia closely approximating those properties of blades of Kentucky Blue Grass.

Still another object of the present invention is to provide an artificial grass product having superior ultraviolet stability and weathering resistance in the absence or presence of an ultraviolet stabilizer or antioxidant.

A further object of the present invention is to provide an artificial grass containing additives, such as ultraviolet stabilizers or antioxidants, to improve ultraviolet stability and weathering resistance.

A still further object of this invention is to provide an artificial grass product having improved resistance to cigarette burning.

Yet another object of the present invention is to provide an artificial grass product made from particular polymers in order to achieve the above-described objects and advantages.

SUMMARY OF THE INVENTION

The artificial grass product of the present invention is made of yarn comprised of fibers or a single fiber having an elastic modulus of from 25,000 pounds/inch$^2$ (p.s.i.) to 100,000 p.s.i. and a moment of inertia about the x- or y-axis of from $1.06\times10^{-10}$ inch$^4$ (in.$^4$) to $8.33\times10^{-9}$ in.$^4$. The yarn of the invention is manufactured either by extrusion/spinning through spinnerettes or by slitting of a polymer film. For specific details of this process reference is made to copending Benedyk application Ser. No. 17,465 previously referred to.

The elastic modulus and moment of inertia properties of the fibers of this invention allow use of yarn having substantially thicker fibers than are currently used in the art. Furthermore, the yarn may contain a mixture of fibers having varying cross-sectional shapes, elastic moduli and/or area moments of inertia. The yarn may be either twisted or braided from any number of the fibers described above.

Alternatively, the pile product of the invention may be made from single fibers having the properties described above.

The fibers of the artificial grass products of the invention closely simulate blades of Kentucky Blue Grass with respect to breaking load, ultimate tensile strength and elastic modulus. A turf product made with these fibers provides a surface more closely resembling natural grass than any conventional artificial grass product.

The invention may be better understood by reference to the appended drawings in which.

THE FIBERS

Figure 1:
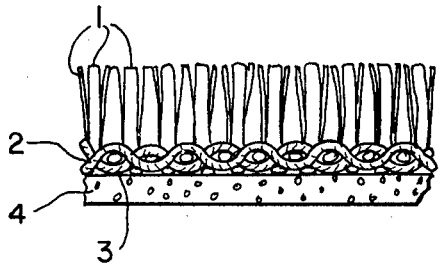
FIG. 1 is a cross-sectional view of a synthetic turf made by conventional methods using a braided yarn comprising fibers of the present invention.

The fibers of the invention may be of rectangular, triangular or circular cross-section or combinations thereof. The fibers have an elastic modulus of from 25,000 p.s.i. to 100,000 p.s.i. and an area moment of inertia ($bh^3/12$, where b is width and h is thickness of a rectangular cross-section taken perpendicular to the longitudinal axis of the fiber) of from $1.06\times10^{-10}$ to $8.33\times10^{-9}$ in.$^4$. For a rectangular cross-section, the fiber dimensions should range from 0.004 in. to 0.010 in. in thickness and 0.020 in. to 0.100 in. in width. These fibers may be extruded from commercially available ethylene-vinyl acetate copolymers, preferably from such copolymers having 3 to 5% vinyl acetate.

U.S. Pat. No. 3,573,147, which is incorporated herein by reference, discusses a method of making suitable ribbon-shaped fibers which may be used to produce the fibers of the invention.

The ribbon-like fibers can be made by extrusion from a rectangular, slotted orifice dimensioned to produce fibers having a thickness of between 0.004 in. and 0.010 in. and a width of between 0.020 in. and 0.100 in. since fibers having these cross-sectional dimensions possess good flexing and bending characteristics. However, as noted above, the cross-sections need not be rectangular-shaped. Where the fibers have a generally circular cross-section, the diameter may be from about 0.003 to 0.006 in.

The ribbon-like fibers can also be made by slitting of plastic film or sheet having a thickness of between 0.004 in. and 0.010 in. to a fiber width of between 0.020 in. and 0.100 in.

CROSS-LINKING

The fibers are cross-linked by use of ionizing radiation, such as gamma rays emitted by radioactive elements and isotopes, x-rays, rays of subatomic charged particles including electrons, protons, deuterons, and rays of neutrons.

The dosage of radiation should be sufficient to cross-link the molecules to the extent that they have a gel content greater than 25% but less than 90%. The preferred gel content is 45–55%. Gel content of the ethylene-vinyl acetate fiber, for example, is determined according to the following procedure:

Fibers are wound around a metal wire screen and subjected to solvent elution in hot xylene near the boiling point for 24 hours. Gel content is then calculated using the formula:

$$\% \text{ gel} = W_f/W_o \times 100$$

Where $W_o$ is the initial weight of the sample and $W_f$ is the final weight after elution.

To enhance cross-linking there may be distributed throughout the polymeric material fine particles of silicon dioxide, titanium dioxide or some other inorganic filler which enhances radiation cross-linking. The particle size of these oxides ranges between 100 angstroms and 1 micron and the amount used is below 1 volume percent. This small amount of inorganic filler improves the efficiency of the irradiation step. For example, a polymeric material irradiated at a dosage of 10 megarads (MR) will have a gel content of 25–28%. When this same polymer includes 0.2 volume percent silicon dioxide and is irradiated at the same dosage, the gel content 40–45%. This increase in gel content represents a substantial increase in the melting point of the polymeric material. The addition of polyfunctional monomers also improves cross-linking. For example, triallyl cyanurate or triallyl acylate, alone or in combination with the oxides, are additives which enhance the cross-linking yield for a given radiation dosage.

The thermoplastic materials of the invention may be cross-linked before, during or after the fibers are formed, or during or after the pile fabric is made. Miltz and Narkis (J. Appl. Polymer Sci. 20: 1627–1633 (1976)) have described the synergistic effect which occurs when cross-linking, such as described above, and ultraviolet stabilization are combined in raising the ultraviolet resistance of low density polyethylene.

THE YARN

The yarn can be made by extrusion, by direct attenuation in the melt to final cross-sectional shape, by combined melt attenuation and solid phase drawing, or by slitting of solid film. The yarn may consist of a combination of fibers having various cross-sectional shapes or dimensions. Preferably, the yarn is made from ethylene-vinyl acetate copolymers that are cross-linkable by exposure to ionizing irradiation. The cross-linking imparts several advantages to the product: high temperature resistance, improved ultraviolet light resistance, improved cigarette burn resistance, and improved abrasion resistance.

Braiding or twisting of the above-described fibers may be accomplished on any conventional braiding or twisting machine as, for example, one designed which accomodates from 4 to 8 carriers. The desired flexibility of the braided yarn for conventional tufting makes it preferable that no central fiber be included in the braid when it is subjected to tufting. Any conventional tufting technique may be used with the braided or twisted filaments. When tension is applied to the yarn by the maching during tufting, all of the ends pull together into a tight yarn which easily passes through the machine elements.

THE PILE TURF

A detailed description of the production of artificial grass made from ribbon-like fibers can be found in U.S. Pat. No. 3,551,263, which is incorporated herein by reference. Basically, the invention described therein provides a cut pile-type synthetic turf having fibers of substantially rectangular cross-section.

Also discussed therein is a method of preparing a yarn consisting of the above-described fibers suitable for conventional cut pile tufting in the production of synthetic turf. Four to eight of the fibers are braided or twisted into a yarn which is secured by conventional cut pile tufting, weaving, knitting, or otherwise to form a structure consisting of a backing having a cut pile face extending from one surface thereof. Where tufting, knitting or weaving is employed, a suitable latex formulation is applied to the other surface of the backing to render the complete structure dimensionally stable. A polymeric elastomer may then be applied to the latex backing to provide a more stable and improved structure.

FIG. 1 is a cross-sectional view of a synthetic turf produced by the conventional methods discussed in U.S. Pat. No. 3,551,263 using a braided yarn. Fibers 1 emerge from the fiber backing 2, the pile being anchored securely therein by a bonding agent 3. A polyvinyl chloride foam 4 has been applied to the backing to improve the physical properties of the turf.

Figure 2:
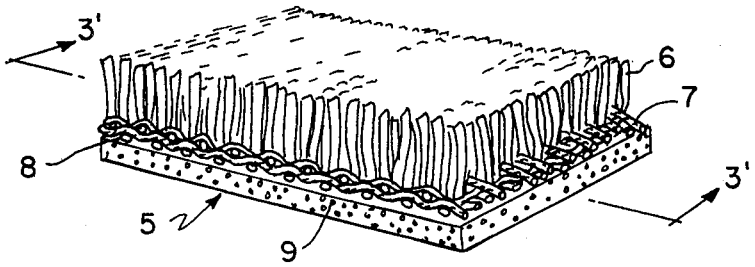
FIG. 2 is a perspective view of a synthetic turf made by conventional methods using single fibers of the invention.
Figure 3:
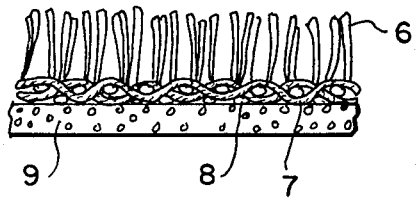
FIG. 3 is a cross-sectional view of the turf of FIG. 2 taken through section 3'—3' of FIG. 2.

In another embodiment, a single fiber pile is used in making the synthetic turf (see FIGS. 2 and 3) according to the process described in U.S. Pat. No. 3,332,828. A portion of the woven turf 5 is shown in which single fibers 6 extend upwardly from a woven synthetic fiber backing 7. The fibers 6 are anchored securely in the backing 7 by a bonding agent 8. A polyvinyl chloride foam 9 is applied on the backing 7 to improve the physical properties of the turf 5.

FIBER PROPERTIES

The mechanical properties of the low modulus, large diameter fibers of the invention were compared to the mechanical properties of blades of Kentucky Blue Grass as follows:

TENSILE TEST

A table model Instron testing machine was used with Instron's "C" load cell at one pound (lb.) full scale deflection for the Kentucky Blue Grass with a cross-head speed of 0.2 inch/minute (in./min.), chart speed of 1 in./min. and a gauge length of 2 in. The fibers of the invention were tested in the same way with the exception of having the load cell at 2 lb. full scale deflection and a cross-head speed of 2 in./min., chart speed of 1 in./min., and a 2 in. gauge length.

BENDING MODULUS TEST

The same Instron machine was used as previously described with the exception of a different gripping arrangement. The load cell used was an "A" cell at 10 grams full-scale deflection, 0.2 in./min. cross-head speed, 10 in./min. chart speed, and 1 in. gauge length.

Table I presents a summary of the tensile properties of Kentucky Blue Grass blades, fibers of the invention formed by drawing or extrusion, and polypropylene fibers used in the prior art to make artificial turf. Table II presents the parameters relating to measurement of the bending modulus.

ULTRAVIOLET EXPOSURE TEST

Ultraviolet radiation as used in the present invention includes radiation in the region of the electromagnetic spectrum including wavelengths from 100 to 3900 angstroms. The material is irradiated for periods of up to 3000 hours in an attempt to simulate exposure to ultraviolet light normally encountered by artificial grass products.

TABLE 1

SUMMARY OF TENSILE PROPERTIES

| Specimen | Cross-Sectional Area (in.$^2$) | Breaking Load (lb.) | Ultimate Tensile Strength ($10^3$psi) | Elastic Modulus ($10^3$psi) | % Elongation in 2 in. |
|---|---|---|---|---|---|
| Kentucky Grass | | | | | |
| # 1 | .00024 | .35 | 1.4 | 41.7* | |
| # 2 | .00028 | .57 | 2.0 | 50.9 | |
| # 3 | .00012 | .55 | 4.5 | 61.6 | |
| # 4 | .00028 | .90 | 3.2 | 45.9 | |

TABLE 1-continued

SUMMARY OF TENSILE PROPERTIES

| Specimen | Cross-Sectional Area (in.$^2$) | Breaking Load (lb.) | Ultimate Tensile Strength ($10^3$psi) | Elastic Modulus ($10^3$psi) | % Elongation in 2 in. |
|---|---|---|---|---|---|
| # 5 | .00012 | .17 | 1.4 | 94.4 | |
| # 6 | .00024 | .17 | 0.70 | 35.4 | |
| # 7 | .00028 | .60 | 2.1 | 61.2 | |
| # 8 | .00028 | .63 | 2.2 | 56.2 | |
| # 9 | .00028 | .27 | 0.96 | 27.5 | |
| # 10 | .00024 | .37 | 1.5 | 51.4 | |
| Drawn Fiber Run #2 | | | | | |
| # 1 | .000328 | 1.04 | 3.1 | 79 | 176 |
| # 2 | .000328 | 1.00 | 3.0 | 61 | 183 |
| # 3 | .000328 | 1.02 | 3.1 | 75.8 | 148 |
| Extruded Fiber Run #1 | | | | | |
| # 1 | .000664 | 1.34 | 2.0 | 53.2 | 218 |
| # 2 | .000547 | 1.09 | 1.9 | 65 | 197 |
| # 3 | .000664 | 1.52 | 2.2 | 59 | 303 |
| Extruded Fiber Run #2 | | | | | |
| # 1 | .000469 | 1.05 | 2.2 | 66.3 | 215 |
| # 2 | .000469 | 1.07 | 2.2 | 68.2 | 180 |
| # 3 | .000500 | 1.10 | 2.2 | 64 | 228 |
| Polypropylene Fiber (Bundled-Yarn) | | | | | |
| # 1 | .001265 | 37.5 | 34 | 225 | 93 |
| # 2 | .001265 | 40 | 36 | 263 | 77 |
| # 3 | .001265 | 46 | 42 | 197 | 110 |

*Low values for data of ELASTIC MODULUS VS. values for BENDING MODULUS of the natural grass may be attributed to samples breaking near the grip.

TABLE II

BENDING MODULUS

| Sample | h (in.) | b (in.) | δ (in.) | P ($10^{-5}$ lb.) | l (in.) | I ($10^{-9}$ in.$^4$) | E ($10^3$psi) | K ($10^{-5}$lb.-in.$^2$) |
|---|---|---|---|---|---|---|---|---|
| Drawn Fibers Run #3 | | | | | | | | |
| # 1 | .0075 | .0625 | .06 | 44.05 | .5 | 2.196 | 141 | 30.97 |
| # 2 | .0075 | .0625 | .08 | 27.50 | .5 | 2.196 | 65.2 | 14.32 |
| # 3 | .0075 | .0625 | .10 | 33.00 | .5 | 2.196 | 65.2 | 13.67 |
| # 4 | .0080 | .0625 | .08 | 22.02 | .5 | 2.666 | 43 | 11.46 |
| # 5 | .0080 | .0625 | .08 | 22.02 | .5 | 2.666 | 43 | 11.46 |
| Kentucky Blue Grass | | | | | | | | |
| # 1 | .0060 | .0859 | .08 | 33.03 | .5 | 1.546 | 110 | 17.20 |
| # 2 | .0060 | .0937 | .07 | 55.06 | .5 | 1.686 | 194 | 32.77 |
| # 3 | .0060 | .0937 | .07 | 44.05 | .5 | 1.686 | 155 | 26.22 |
| # 4 | .0060 | .10937 | .06 | 88.10 | .5 | 1.968 | 305 | 60.17 |
| # 5 | .0060 | .10937 | .07 | 66.07 | .5 | 1.968 | 199 | 39.33 |
| Polypropylene (Bundled Synthetic Grass Yarn - Thiokol Corp.) | | | | | | | | |
| # 1 | .013 | .0937 | .0385 | 616.7 | .5 | 17.154 | 389 | 667.42 |
| # 2 | .014 | .0937 | .0230 | 638.7 | .5 | 21.426 | 540 | 1,157.00 |
| Drawn Fibers Run #2 | | | | | | | | |
| # 1 | .007 | .0625 | .09 | 22.02 | .5 | 1.786 | 57 | 10.198 |
| # 2 | .007 | .0625 | .09 | 22.02 | .5 | 1.786 | 57 | 10.198 |
| Extruded Fibers Run #2 | | | | | | | | |
| # 1 | .008 | .0625 | .09 | 33.03 | .5 | 2.666 | 57 | 15.292 |
| # 2 | .008 | .0625 | .07 | 33.03 | .5 | 2.666 | 73 | 19.660 |

b = width of sample
h = thickness of sample
p = load placed on sample
δ = amount of deflection
l = lever arm
I = the moment of inertia of a rectangular specimen ($bh^3/12$)
$E = Pl^3/3I$
K = E × I (stiffness parameter)

EXAMPLE I

A synthetic poly(ethylene-vinyl acetate) turf was produced by tufting a 6 ply twisted yarn comprised of fibers of rectangular cross-section with dimensions 0.004 in.×0.080 in. The fibers have an elastic modulus of about 80,000 p.s.i. and an area moment of inertia of about $4.0\times10^{-9}$ in$^4$. The fibers were inserted into a backing of a ⅛ in. thick sheet of polyurethane foam which was reinforced by a nylon scrim. The tufts were cut to form a turf with a pile height of ⅜ in. and the back of the fabric was latexed to firmly anchor the nylon and prevent shedding.

EXAMPLE II

The flat fibers of Example I were tufted into standard Chemback tufting medium and sheared to ¼ in. pile height with 18 ounces of fiber per square yard of fabric. A latex adhesive was applied to the underside of a portion of the fabric and a non-woven rayon-polyolefin scrim was applied to the adhesive to form a secondary backing.

EXAMPLE III

A copolymer of ethylene and vinyl acetate (97:3) was used to form fibers contained in a synthetic turf made according to Example II. Three samples were treated as follows:

A. No radiation cross-linking treatment

B. 10 megarad electron beam radiation cross-linking treatment which resulted in a 27% gel content.

C. 50 megarad electron beam radiation cross-linking treatment which resulted in a 74% gel content.

These samples and a comparable conventional polypropylene artificial turf were tested by placing a freshly lit cigarette on the pile surface and allowing it to burn completely. The fibers of Sample A which had no cross-linking treatment were fused together on the tips along the length of the burn. Sample B fibers, which had been exposed to 10 megarad electron beam radiation exhibited no fusion along the burn area. However, some shrinkage of the fibers was evident. Fibers of Sample C which were exposed to 50 megarad electron beam radiation showed lack of fusion and apparent lack of shrinkage. In contrast, a conventional polypropylene artificial turf (Sample D) burned completely through to the backing.

Samples B and C were also subjected to a severe static compression test. These showed a remarkable degree of recovery or resilience compared with samples A and D.

Without wishing to be bound by any particular theory, it is believed that the cigarette burn resistance of the radiation cross-linked ethylene-vinyl acetate samples is due to several factors: filament size, pile density and height, and degree of cross-linking. The filament size, pile density and height are related to heat transfer between cigarette and pile. The heat transfer from the burning cigarette to the top of the pile is related by:

$$Q=hA(T_c-T_p)=k(A^1/l^1)(T_o-T_p)+c_p\rho V(T_o-T_p)$$

where h is the surface coefficient of heat transfer of the cigarette to the pile, A is the area, $l^1$ is the length, k is the thermal conductivity of pile, $A^1$ is related to cross-section of filament, $c_p$ is heat capacity, $\rho$ is density, V is volume, $T_c$ is cigarette tip temperature, $T_p$ is average temperature of pile, $T_o$ is temperature of pile directly in contact with cigarette.

EXAMPLE IV

Various monofilament fibers of the invention were exposed to ultraviolet radiation (xenon lamp) for periods of up to 3000 hours and then tested for changes in elongation, tensile strength, etc. The fibers of the invention tested throughout were made from 5% vinyl acetate and 95% ethylene monomers. The fiber samples were divided into three groups. Samples of Group I were not subject to any cross-linking treatment. Groups II and III samples were exposed to 5 and 10 megarad electron beam radiation cross-linking treatment respectively. These groups were then subdivided and exposed to ultraviolet light for from 0 to 3000 hours (See Tables III to V).

Referring now to Table III, in which the fibers tested contained ultraviolet stabilizers, and Table IV, in which the fibers tested contained ultraviolet stabilizers and an antioxidant, samples of Group II (cross-linked with 5 megarad electron beam radiation) show the best results.

Comparing the results for fibers containing ultraviolet stabilizers (Tables III and IV) and for fibers without the stabilizers (Table V) it can be seen that the addition of stabilizers significantly increases the maximum elongation parameter after exposure to ultraviolet light.

TABLE III

SAMPLE NO. 1 MONOFILAMENT TOW
DIAMETER 1676 DENIER
WITH U.V. STABILIZERS

| Time Exposed to U.V. Light (Hr.) | | 0 | 300 | 600 | 900 | 1200 | 1500 | 1800 | 2100 | 2400 | 2700 | 3000 |
|---|---|---|---|---|---|---|---|---|---|---|---|---|
| GROUP I NO RADIATION | | | | | | | | | | | | |
| | .05 g./den. | 4 | 4 | 6 | 4 | 4 | 4 | 4 | 4 | B | 3 | 3 |
| Elongation (%) | .10 g./den. | 33 | 25 | 30 | 35 | 14 | 17 | 21 | 34 | R | 15 | 30 |
| | .15 g./den. | 128 | 84 | 120 | 162 | 62 | 77 | — | 154 | I | — | 147 |
| 20% Offset Yield | (g./den.) | .091 | .103 | .100 | .089 | .057 | .107 | .106 | .098 | T | .105 | .095 |
| Yield Elongation | (%) | 24 | 28 | 29 | 25 | 29 | 26 | 27 | 29 | T | 20 | 25 |
| Tensile Strength | (g./den.) | .176 | .178 | .177 | .164 | .190 | .174 | .112 | .174 | L | .109 | .155 |
| Maximum Elongation | (%) | 285 | 270 | 317 | 270 | 263 | 264 | 270 | 335 | E | 27 | 194 |
| GROUP II 5 Megarad Radiation | | | | | | | | | | | | |
| | .05 g./den. | 9 | 4 | 5 | 4 | | 4 | 3 | | 3 | 5 | 5 |
| Elongation (%) | .10 g./den. | 43 | 26 | 31 | 24 | | 24 | 20 | | 11 | 32 | 30 |
| | .15 g./den. | — | 81 | 99 | 75 | | 76 | 75 | | 44 | — | — |
| 20% Offset Yield | (g./den.) | — | .100 | .098 | .103 | | .106 | .106 | | .109 | .110 | .099 |
| Yield Elongation | (%) | 32 | 26 | 29 | 26 | | 28 | 25 | | 36 | 35 | 27 |
| Tensile Strength | (g./den.) | .147 | .192 | .180 | .198 | | .192 | .200 | | .152 | .142 | .135 |
| Maximum Elongation | (%) | 187 | 300 | 255 | 308 | | 273 | 305 | | 173 | 120 | 100 |

TABLE III-continued

| SAMPLE NO. 1 MONOFILAMENT TOW DIAMETER 1676 DENIER WITH U.V. STABILIZERS | | | | | | | | | | | | |
|---|---|---|---|---|---|---|---|---|---|---|---|---|
| Time Exposed to U.V. Light (Hr.) | | 0 | 300 | 600 | 900 | 1200 | 1500 | 1800 | 2100 | 2400 | 2700 | 3000 |
| GROUP III 10 Megarad Radiation | | | | | | | | | | | | |
| | .05 g./den. | 5 | 6 | 6 | 5 | 5 | 3 | 5 | | 5 | 5 | 4 |
| Elongation (%) | .10 g./den. | 24 | 18 | 44 | 27 | 22 | 7 | 50 | | — | 38 | — |
| | .15 g./den. | 94 | 54 | 212 | 84 | 105 | 16 | — | | — | — | — |
| | .20 g./den. | — | 138 | — | — | — | 42 | — | | — | — | — |
| 20% Offset Yield | (g./den.) | .110 | .115 | .082 | .103 | .109 | .195 | .082 | | .094 | .093 | N/A |
| Yield Elongation | (%) | 30 | 31 | 30 | 30 | 30 | 38 | 28 | | 27 | 29 | N/A |
| Tensile Strength | (g.den.) | .199 | .230 | .175 | .206 | .196 | .310 | .124 | | .095 | .114 | .095 |
| Maximum Elongation | (%) | 334 | 250 | 312 | 330 | 328 | 270 | 125 | | 31 | 60 | 25 |

TABLE IV

| SAMPLE NO. 4 MONOFILAMENT TOW DIAMETER 1288 DENIER WITH U.V. STABILIZERS AND ANTIOXIDANT | | | | | | | | | | | | |
|---|---|---|---|---|---|---|---|---|---|---|---|---|
| Time Exposed to U.V. Light (hr.) | | 0 | 300 | 600 | 900 | 1200 | 1500 | 1800 | 2100 | 2400 | 2700 | 3000 |
| GROUP I NO RADIATION | | | | | | | | | | | | |
| | .05 g./den. | 4 | 7 | 4 | 3 | 3 | 3 | 5 | 5 | 5 | 4 | 5 |
| Elongation (%) | .10 g./den. | 17 | 29 | 14 | 16 | 14 | 15 | 27 | 25 | 31 | 12 | 8 |
| | .15 g./den. | 46 | 74 | 34 | 53 | 48 | 47 | 75 | 85 | — | 44 | 50 |
| | .20 g./den. | 127 | — | 112 | — | 200 | — | — | — | — | — | — |
| 20% Offset Yield | (g./den) | .155 | .102 | .127 | .113 | .123 | .115 | .106 | .103 | .106 | .132 | .121 |
| Yield Elongation | (%) | 27 | 30 | 28 | 27 | 32 | 25 | 32 | 30 | 27 | 20 | 27 |
| Tensile Strength | (g./den.) | .218 | .167 | .209 | .189 | .200 | .168 | .161 | .156 | .109 | .182 | .182 |
| Maximum Elongation | (%) | 205 | 130 | 160 | 176 | 200 | 75 | 120 | 137 | 35 | 92 | 115 |
| GROUP II 5 Megarad Radiation | | | | | | | | | | | | |
| | .05 g./den. | 5 | 3 | 5 | 4 | | 4 | 4 | | 4 | 4 | 3 |
| Elongation (%) | .10 g./den. | 16 | 9 | 17 | 13 | | 14 | 15 | | 12 | 8 | 13 |
| | .15 g./den. | 50 | 37 | 53 | 45 | | 54 | 55 | | — | 50 | — |
| | .20 d./den. | 170 | 77 | 190 | 135 | | 214 | — | | — | — | — |
| 20% Offset Yield | (g./den) | .114 | .134 | .119 | .103 | | .120 | .118 | | .130 | .130 | .110 |
| Yield Elongation | (%) | 29 | 27 | 32 | 26 | | 30 | 30 | | 35 | 18 | 25 |
| Tensile Strength | (g./den.) | .203 | .242 | .211 | .198 | | .210 | .179 | | .172 | .153 | .132 |
| Maximum Elongation | (%) | 189 | 263 | 247 | 308 | | 260 | 132 | | 88 | 55 | 60 |
| GROUP II 10 Megarad Radiation | | | | | | | | | | | | |
| | .05 g./den. | 3 | 3 | 4 | 4 | 4 | 3 | 4 | | 4 | 3 | 3 |
| Elongation (%) | .10 g./den. | 11 | 16 | 9 | 14 | 10 | 11 | 11 | | 14 | — | 12 |
| | .15 g./den. | 44 | 50 | 37 | 50 | 47 | 57 | 47 | | 56 | — | — |
| | .20 g./den. | 126 | 204 | 95 | 150 | — | — | — | | — | — | — |
| 20% Offset Yield | (g./den.) | .123 | .114 | .141 | .123 | .129 | .130 | .122 | | .115 | .133 | .126 |
| Yield Elongation | (%) | 25 | 24 | 30 | 28 | 30 | 37 | 28 | | 28 | 27 | 29 |
| Tensile Strength | (g./den.) | .249 | .206 | .233 | .213 | .189 | .198 | .175 | | .155 | .136 | .127 |
| Maximum Elongation | (%) | 287 | 227 | 230 | 220 | 155 | 215 | 84 | | 83 | 35 | 30 |

TABLE V

| SAMPLE NO. 9 MONOFILAMENT TOW DIAMETER 1549 DENIER WITHOUT U.V. STABILIZERS | | | | | | | | | | |
|---|---|---|---|---|---|---|---|---|---|---|
| Time Exposed to U.V. Light (Hr.) | | 0 | 300 | 600 | 900 | 1200 | 1500 | 1800 | 2100 | 2400 |
| GROUP I NO RADIATION | | | | | | | | | | |
| | .05 g./den. | 5 | 4 | 4 | 3 | 2 | 4 | 2 | 2 | Too |
| Elongation (%) | .10 g./den. | 18 | 17 | 13 | 4 | 4 | 8 | 8 | 4 | Brittle |
| | .15 g./den. | 50 | 110 | — | 34 | 23 | — | — | — | To |
| | .20 g./den. | 195 | 310 | — | — | — | — | — | — | Test |
| 20% Offset Yield | (g./den. | .130 | .114 | .121 | .144 | .153 | .129 | .127 | N/A | Beyond |
| Yield Elongation | (%) | 35 | 27 | 28 | 26 | 29 | 25 | 25 | N/A | 2100 |
| Tensile Strength | (g./den.) | .290 | .200 | .128 | .156 | .161 | .134 | .128 | .141 | Hrs. |
| Maximum Elongation | (%) | 495 | 365 | 198 | 72 | 60 | 44 | 33 | 18 | |
| GROUP II 5 Megarad Radiation | | | | | | | | | | |
| | .05 g./den. | 5 | 4 | 5 | 4 | 2 | 2 | 1 | Too | |
| Elongation (%) | .10 g./den. | 13 | 6 | — | 7 | 5 | 4 | 3 | Brittle | |
| | .15 g./den. | 40 | 22 | — | — | 18 | 10 | — | To | |
| | .20 g./den. | 148 | — | — | — | | — | — | Test | |
| 20% Offset Yield | (g./den. | .139 | .158 | .072 | .121 | .150 | .170 | N/A | Beyond | |
| Yield Elongation | (%) | 32 | 28 | 27 | 27 | 20 | 27 | N/A | 1800 | |
| Tensile Strength | (g./den.) | .301 | .183 | .074 | .122 | .150 | .170 | .134 | Hrs. | |

TABLE V-continued

| | | SAMPLE NO. 9 MONOFILAMENT TOW DIAMETER 1549 DENIER WITHOUT U.V. STABILIZERS | | | | | | | | |
|---|---|---|---|---|---|---|---|---|---|---|
| Time Exposed to U.V. Light (Hr.) | | 0 | 300 | 600 | 900 | 1200 | 1500 | 1800 | 2100 | 2400 |
| Maximum Elongation | (%) | 438 | 258 | 54 | 28 | 20 | 27 | 5 | | |
| GROUP III 10 Megarad Radiation | | | | | | | | | | |
| | .05 g./den. | 5 | 3 | 2 | 4 | 4 | Too | | | |
| Elongation | .10 g./den. | 15 | 23 | 4 | 14 | 6 | Brittle | | | |
| | .15 g./den. | 44 | — | — | — | — | Test | | | |
| | .20 g./den. | 206 | — | — | — | — | Beyond | | | |
| 20% Offset Yield | (g./den.) | .138 | .109 | .145 | .109 | N/A | 1200 | | | |
| Yield Elongation | (%) | 34 | 32 | 25 | 26 | N/A | Hrs. | | | |
| Tensile Strength | (g./den.) | .293 | .146 | .148 | .112 | .135 | | | | |
| Maximum Elongation | (%) | 407 | 255 | 52 | 37 | 25 | | | | |

What is claimed:

1. A cigarette burn proof artificial grass product, comprising: a pile fabric with twisted yarn comprised of a plurality of fibers made of an ethylene-vinyl acetate copolymer and having an elastic modulus of from 25,000 p.s.i. to 100,000 p.s.i. and a moment of inertia of from $1.06\times10^{-10}$in.$^4$ to $8.33\times10^{-9}$in.$^4$, the fibers extending from and substantially perpendicular to a backing to which the fibers are secured, wherein the yarn is twisted at the part of emergence from the backing, and wherein the copolymer is cross-linked by exposure to an effective amount of ionizing radiation to achieve a gel content of from about 25 to 75 percent.

2. The artificial grass product of claim 1, wherein the copolymer comprises from 3 to 5 percent vinyl acetate and from 97 to 95 percent ethylene.

3. The artificial grass product of claim 2, wherein the fibers have a rectangular cross-section of from 0.004 in. to 0.010 in. in thickness and from 0.020 in. to 0.100 in. in width.

4. The artificial grass product of claim 3, wherein the copolymer contains a compound which enhances radiation cross-linking.

5. The artificial grass product of claim 4, wherein the compound is particulate silicon dioxide or titanium dioxide.

6. The artificial grass product of claim 3, wherein the ionizing radiation is from 5 to 100 megarads.

7. The artificial grass product of claim 3, wherein the polymeric material has dispersed therein an additive selected from the group consisting of colorants, fillers, flame retardants, ultraviolet stabilizers, antioxidants, antistatic agents and antisoiling agents.

8. The artificial grass product of claim 3, wherein the polymeric material contains an antioxidant.

9. The artificial grass product of claim 3, wherein the polymeric material contains an ultraviolet stabilizer.

10. the artificial grass product of claim 2, wherein the fibers have a generally circular cross-section of from 0.003 to 0.006 in. in diameter.

11. The artificial grass product of claim 1, wherein the fibers are tufted into the backing.

12. The artificial grass product of claim 1, wherein the fibers are woven into a warp and fill backing.

13. The artificial grass product of claim 1, wherein the fibers are knitted with the fibers of the backing.

14. A cigarette burn proof artificial grass product, comprising: a pile fabric with twisted yarn comprised of a single fiber made of an ethylene-vinyl acetate copolymer and having an elastic modulus of from 25,000 p.s.i. to 100,000 p.s.i. and a moment of inertia of from $1.06\times10^{-10}$in.$^4$ to $8.33\times10^{-9}$in.$^4$, the yarn tufted into a backing to form successive rows of loops of the fiber which are cut to provide a cut-pile face, and wherein the copolymer is cross-linked by exposure to an effective amount of ionizing radiation to achieve a gel content of from about 25 to 75 percent.

15. The artificial grass product of claim 14, wherein the copolymer comprises from 3 to 5 percent vinyl acetate and from 97 to 95 percent ethylene.

16. The artificial grass product of claim 15, wherein the fibers have a rectangular cross-section of from 0.004 in. to 0.010 in. in thickness and from 0.020 in. to 0.100 in. in width.

17. The artificial grass product of claim 16, wherein the copolymer contains a compound which enhances radiation cross-linking.

18. The artificial grass product of claim 17, wherein the compound is silicon dioxide or titanium dioxide.

19. The artificial grass product of claim 16, wherein the ionizing radiation is from 5 to 100 megarads.

20. The artificial grass product of claim 16, wherein the polymeric material has dispersed therein an additive selected from the group consisting of colorants, fillers, flame retardants, ultraviolet stabilizers, antioxidants, antistatic agents and antisoiling agents.

21. The artificial grass product of claim 16, wherein the polymeric material contains an antioxidant.

22. The artificial grass product of claim 16, wherein the polymeric material contains an ultraviolet stabilzer.

23. The artificial grass product of claim 15, wherein the fibers have a generally circular cross-section of from 0.003 to 0.006 in. in diameter.

24. The artificial grass product of claim 14, wherein the fibers are tufted into the backing.

25. The artificial grass product of claim 14, wherein the fibers are woven into a warp and fill backing.

26. The artificial grass product of claim 14, wherein the fibers are knitted with the fibers of the backing.

* * * * *